US005800315A

United States Patent [19]

Yu et al.

[11] Patent Number: 5,800,315

[45] Date of Patent: Sep. 1, 1998

[54] OVAL TRACK EXERCISING CLIMBER

[76] Inventors: Hui-Nan Yu; Michael Lin, both of 5F-23, 70, Fu-Shing Road, Taoyuan, Taiwan

[21] Appl. No.: 961,076

[22] Filed: Oct. 30, 1997

[51] Int. Cl.[6] ..... A63B 22/04; A63B 69/16

[52] U.S. Cl. ..... 482/57; 482/51

[58] Field of Search ..... 482/51, 52, 53, 482/57, 70, 71, 79, 80

[56] References Cited

U.S. PATENT DOCUMENTS

| | | | |
|---|---|---|---|
| 5,290,211 | 3/1994 | Stearns | 482/53 |
| 5,423,729 | 6/1995 | Eschenbach | 482/70 |
| 5,518,473 | 5/1996 | Miller | 482/57 |
| 5,611,756 | 3/1997 | Miller | 482/51 |
| 5,630,774 | 5/1997 | Geschwender | 482/57 |
| 5,707,321 | 1/1998 | Maresh | 482/57 |

*Primary Examiner*—Stephen R. Crow
*Attorney, Agent, or Firm*—Bacon & Thomas

[57] ABSTRACT

An oval track exercising climber including a pair of pedals pivotably supported between a pair of oscillating bars and a pair of guide bars, and a pair of links pivotably coupled between the oscillating bars and the guide bars, the connecting points between the guide bars and the links being respectively pivoted to a pair of cranks, the pedals being forced to move along an oval track and pedaled.

1 Claim, 5 Drawing Sheets

OVAL TRACK EXERCISING CLIMBER

BACKGROUND OF THE INVENTION

The present invention relates to climbers, and more particularly to an oval track exercising climber.

Regular climbers are commonly comprised of a machine base, a pair of hydraulic cylinders, and a pair of pedals having a respective front end respectively pivoted to the machine base and a respective rear end respectively supported on the hydraulic cylinders. When operated, the pedals are alternatively moved up and down along a curved track.

SUMMARY OF THE INVENTION

It is the main object of the present invention to provide a climber which enables the user's feet to move along an oval track when pedaling the pedals. According to one embodiment of the present invention, the oval track exercising climber comprises a machine base having a main rod member and a pair of handlebars mounted on the main rod member, the main rod member being provided with an axle bearing at a rear side thereof; an axle revolvably supported on the axle bearing; a pair of cranks respectively connected to two opposite ends of the axle and disposed at two opposite sides of the main rod member, the cranks having a respective outer end; a pair of guide bars having a respective bottom end respectively pivoted to the outer ends of the cranks and a respective top end; a pair of pedals having a respective rear end respectively pivoted to the top ends of the guide bars and a respective front end; a pair of oscillating bars having a respective top end respectively pivoted to the front ends of the pedals and a respective bottom end respectively pivoted to a front side of the machine base; a pair of links having a respective front end respectively pivoted to the oscillating bars on the middle and a respective rear end respectively pivoted to the bottom ends of the guide bars and the outer ends of the cranks; and a damping mechanism mounted on the machine base and adapted to impart a damping resistance to the pedals when the pedals are pedaled to turn the axle through the cranks.

DETAILED DESCRIPTION OF THE PREFERRED EMBODIMENT

Figure 1:
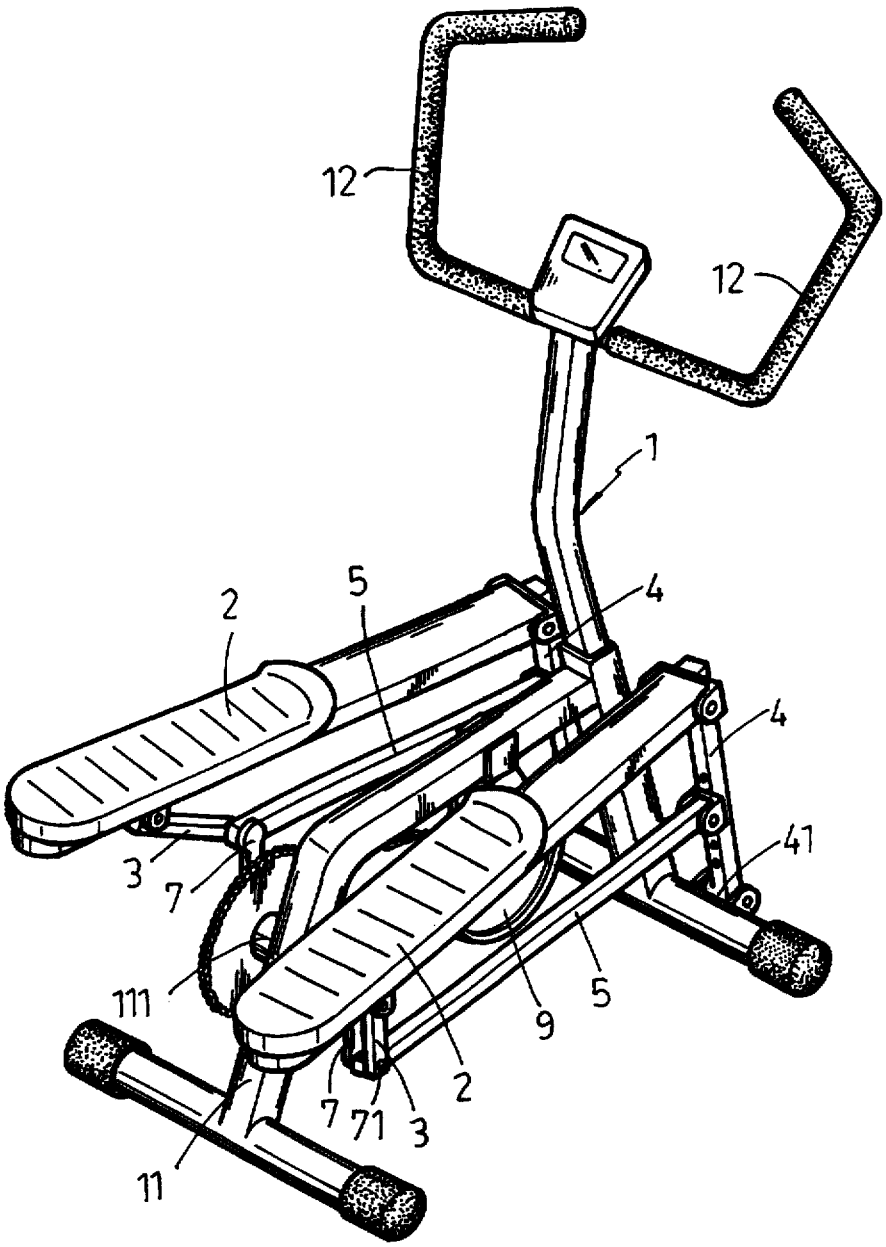
FIG. 1 is a perspective elevational view of an oval track exercising climber according to the present invention.
Figure 2:
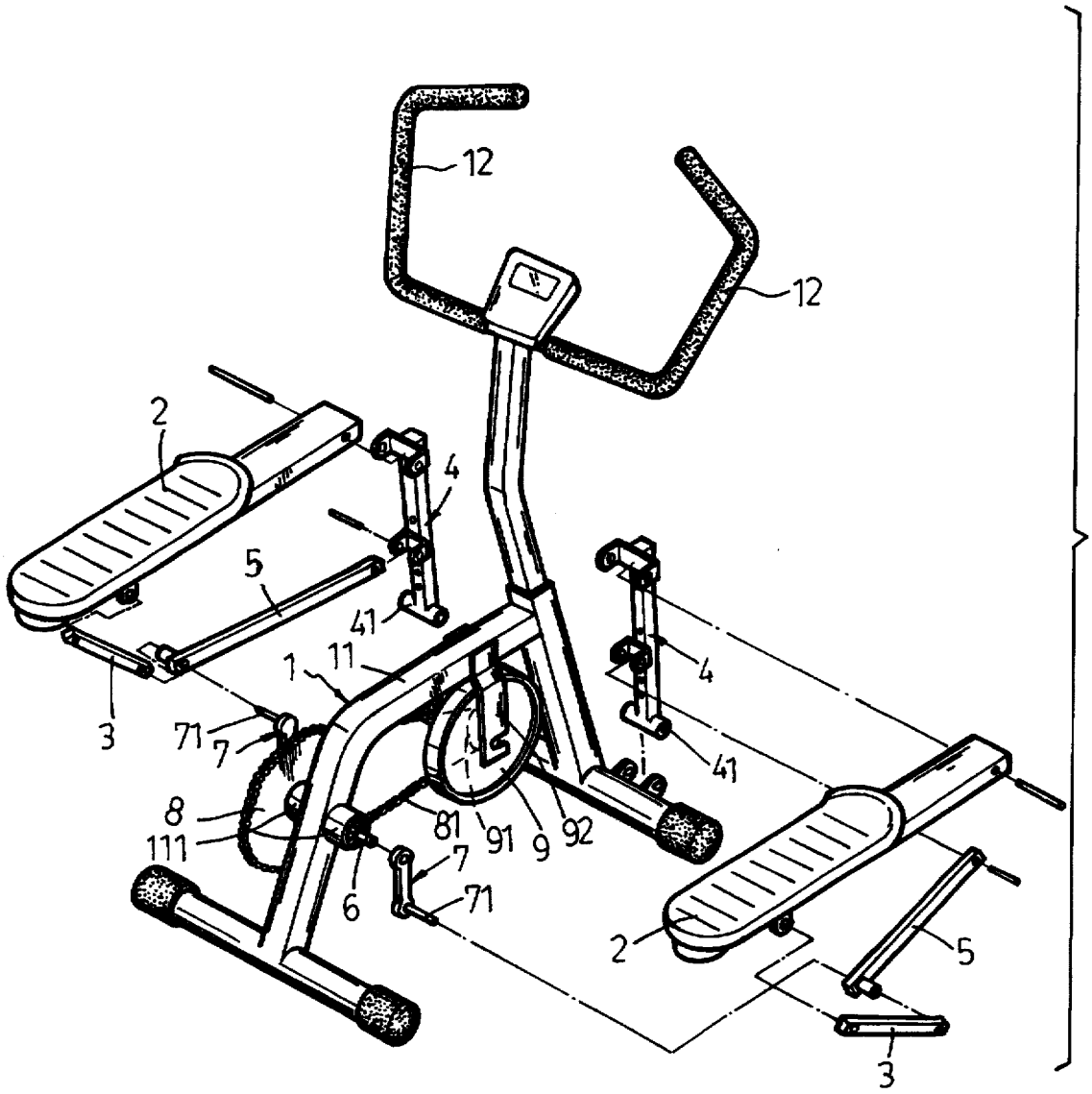
FIG. 2 is an exploded view of the oval track exercising climber shown in FIG. 1.
Figure 3:
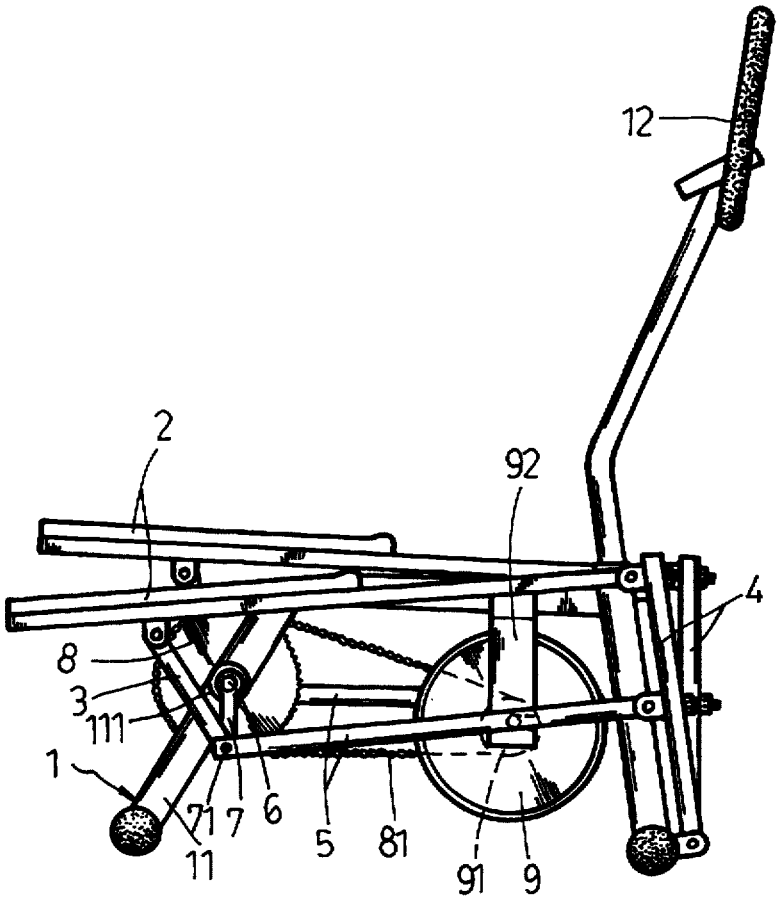
FIG. 3 is a side view of the oval track exercising climber shown in FIG. 1.

Referring to Figures from 1 to 3, a climber in accordance with the present invention is generally comprised of a machine base 1, a pair of pedals 2, a pair of guide bars 3, a pair of oscillating bars 4, a pair of links 5, an axle 6, a pair of cranks 7, and a damping mechanism.

The machine base 1 comprises a main rod member 11, and a pair of handlebars 12. The main rod member 11 is equipped with an axle bearing 111 at its rear side at a suitable elevation. The oscillating bars 4 have a respective transverse barrel 41 at the bottom respectively pivoted to a front side of the machine base 1, and a respective top end respectively pivoted to the pedals 2 at one end. The pedals 2 have a respective front end respectively pivoted to the oscillating bars 4, and a respective rear end respectively pivoted to the guide bars 3. The links 5 have a respective front end pivoted to the oscillating bars 4 on the middle, and a respective rear end respectively pivoted to the guide bars 3. The guide bars 3 have a respective top end respectively pivoted to the pedals 2, and a respective bottom end respectively pivoted to the links 5. The axle 6 is mounted in the axle bearing 111. The cranks 7 are respectively fixed to two opposite ends of the axle 6, having a respective outer end 71 respectively pivoted to the connecting points between the guide bars 3 and the links 5. The aforesaid damping mechanism comprises a chain wheel 8, a chain 81, a fly wheel 9, a sprocket wheel 91, and a damping device (not shown) adapted to impart a damping resistance to the fly wheel 9. The chain wheel 8 is fixedly mounted on the axle 6. The chain 81 is mounted on the chain wheel 8 and the sprocket wheel 91. The fly wheel 9 is revolvably supported on a wheel holder 92, which is suspended from the main rod member 11 of the machine base 1. When the axle 6 is rotated on its own axis, rotary driving power is transmitted from the chain wheel 8 through the chain 81 to the sprocket wheel 91, causing the sprocket wheel 91 to turn the fly wheel 9.

Figure 4:
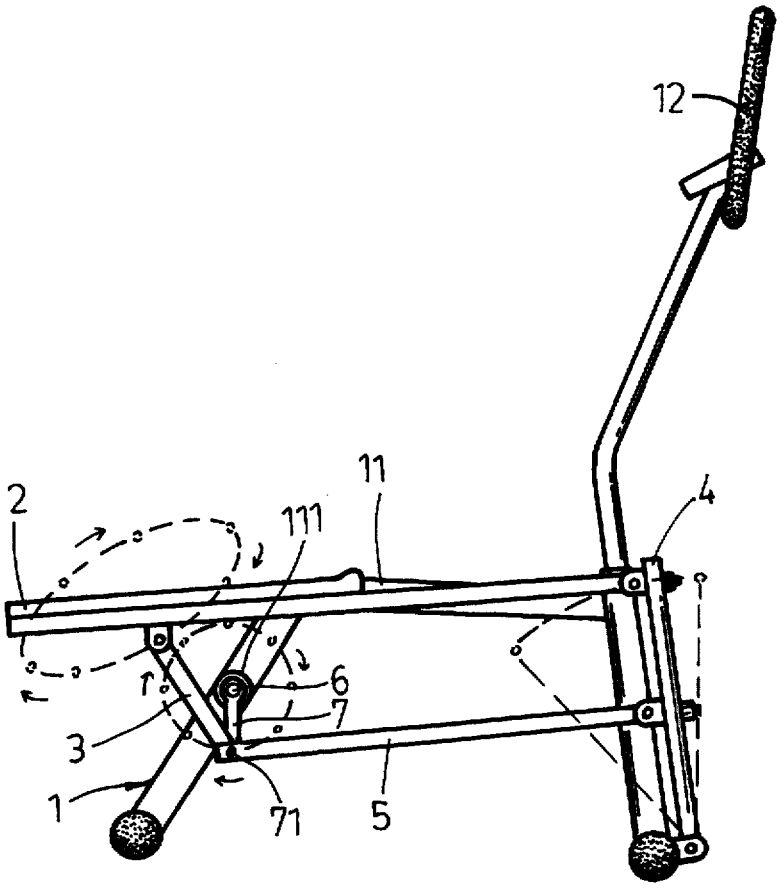
FIG. 4 is a side plain view of the present invention, showing the oval track exercising climber operated.

Referring to FIG. 4, when the pedals 2 are alternatively pedaled, the oscillating bars 4 are alternatively oscillated back and forth, and the cranks 7 are moved to make a circular motion. Because the pedals 2 are respectively pivoted to the top ends of the guide bars 3, the bottom ends of the guide bars 3 are respectively pivoted to the cranks 7, and the links 5 are respectively pivotably coupled between the oscillating bars 4 and the connecting points between the guide bars 3 and the cranks 7, the pedals 2 are forced to move along an oval track when pedaled.

Figure 5:
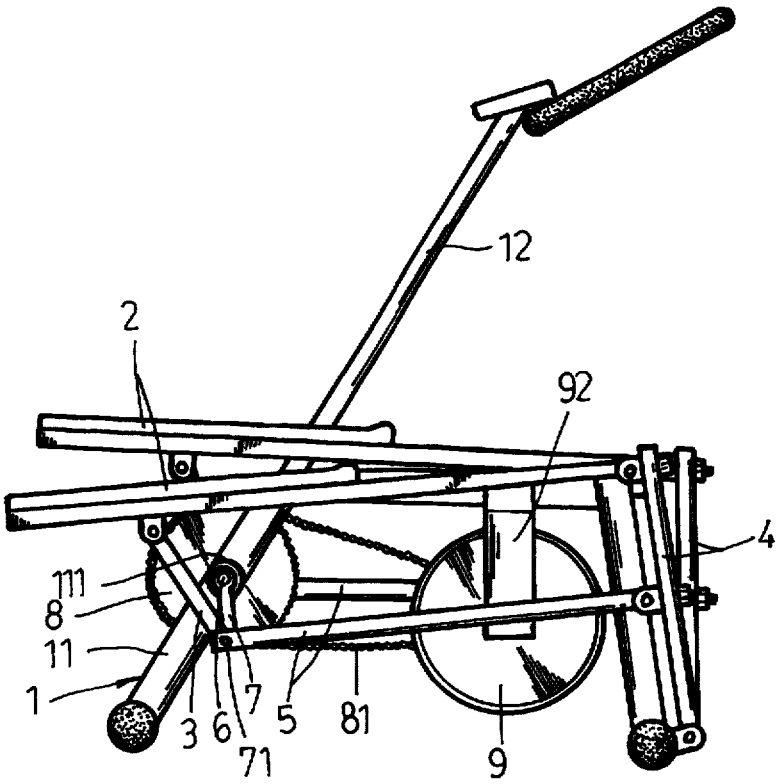
FIG. 5 is a side plain view of an alternate form of the present invention.

FIG. 5 shows an alternate form of the present invention, in which the handlebars 12 are mounted on the rear side of the main rod member 11 of the machine base 1.

It is to be understood that the drawings are designed for purposes of illustration only, and are not intended as a definition of the limits and scope of the invention disclosed.

What the invention claimed is:

1. An oval track exercising climber comprising:

a machine base having a main rod member and a pair of handlebars mounted on said main rod member, said main rod member being provided with an axle bearing at a rear side thereof;

an axle revolvably supported on said axle bearing;

a pair of cranks respectively connected to two opposite ends of said axle and disposed at two opposite sides of said main rod member, said cranks having a respective outer end;

a pair of guide bars having a respective bottom end respectively pivoted to the outer ends of said cranks and a respective top end;

a pair of pedals having a respective rear end respectively pivoted to the top ends of said guide bars and a respective front end;

a pair of oscillating bars having a respective top end respectively pivoted to the front ends of said pedals and a respective bottom end respectively pivoted to a front side of said machine base;

a pair of links having a respective front end respectively pivoted to said oscillating bars on the middle and a respective rear end respectively pivoted to the bottom ends of said guide bars and the outer ends of said cranks; and a damping mechanism mounted on said machine base and adapted to impart a damping resistance to said pedals when said pedals are pedaled to turn said axle through said cranks.

* * * * *